US011459729B2

(12) United States Patent
Kondo et al.

(10) Patent No.: US 11,459,729 B2
(45) Date of Patent: Oct. 4, 2022

(54) HYDRAULIC EXCAVATOR DRIVE SYSTEM

(71) Applicant: KAWASAKI JUKOGYO KABUSHIKI KAISHA, Kobe (JP)

(72) Inventors: Akihiro Kondo, Kobe (JP); Naoki Hata, Kobe (JP); Nobuyuki Kinoshita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/429,731

(22) PCT Filed: Jan. 31, 2020

(86) PCT No.: PCT/JP2020/003582
§ 371 (c)(1),
(2) Date: Aug. 10, 2021

(87) PCT Pub. No.: WO2020/175004
PCT Pub. Date: Sep. 3, 2020

(65) Prior Publication Data

US 2022/0098831 A1 Mar. 31, 2022

(30) Foreign Application Priority Data

Feb. 28, 2019 (JP) ..... JP2019-035681

(51) Int. Cl.
*E02F 9/22* (2006.01)
*F15B 11/024* (2006.01)
(Continued)

(52) U.S. Cl.
CPC ..... *E02F 9/2203* (2013.01); *E02F 9/2217* (2013.01); *E02F 9/2225* (2013.01);
(Continued)

(58) Field of Classification Search
CPC ..... E02F 9/2217; E02F 9/2235; E02F 9/2203; E02F 9/2228; F15B 11/024; F15B 2011/0243
See application file for complete search history.

(56) References Cited

U.S. PATENT DOCUMENTS 4,359,931 A * 11/1982 Palmersheim ..... F15B 11/024 91/441
7,487,707 B2 * 2/2009 Pfaff ..... F15B 13/0433 91/437

(Continued)

FOREIGN PATENT DOCUMENTS

JP 2018-105334 A 7/2018

*Primary Examiner* — Thomas E Lazo
(74) *Attorney, Agent, or Firm* — Oliff PLC

(57) ABSTRACT

A hydraulic excavator drive system includes a regeneration line, which connects an arm pushing and an arm crowding supply line, each of which extends between an arm cylinder and arm control valve. The regeneration line includes regeneration and switching valves. A release line that is branched off from the regeneration line at a position between the regeneration valve and the switching valve is provided with a release valve. A secondary pressure from a first solenoid proportional valve is fed to a pilot port of the regeneration valve such that the regeneration valve opens at a time of arm crowding. A secondary pressure from a second solenoid proportional valve is fed to a pilot port of the release valve such that release valve opens at a time of arm pushing. An arm pushing pilot pressure for moving the arm control valve is led to a pilot port of the switching valve.

6 Claims, 8 Drawing Sheets

(51) Int. Cl.
*F15B 13/02* (2006.01)
*F15B 15/20* (2006.01)

(52) U.S. Cl.
CPC ..... *E02F 9/2267* (2013.01); *E02F 9/2271* (2013.01); *E02F 9/2285* (2013.01); *F15B 11/024* (2013.01); *F15B 13/02* (2013.01); *F15B 15/20* (2013.01); *E02F 9/2292* (2013.01); *E02F 9/2296* (2013.01); *F15B 2211/665* (2013.01)

(56) References Cited

U.S. PATENT DOCUMENTS

| | | | | |
|---|---|---|---|---|
| 9,175,698 | B2 * | 11/2015 | Oguma | F15B 15/202 |
| 2009/0288408 | A1 * | 11/2009 | Tozawa | F15B 11/17 60/435 |
| 2016/0333903 | A1 * | 11/2016 | Peterson | E02F 9/2217 |
| 2019/0323527 | A1 | 10/2019 | Kondo et al. | |

* cited by examiner

HYDRAULIC EXCAVATOR DRIVE SYSTEM

CROSS-REFERENCE TO RELATED APPLICATIONS

This is a U.S. National Phase of International Application No. PCT/JP2020/003582 filed Jan. 31, 2020, which claims the benefit of Japanese Patent Application No. 2019-035681 filed Feb. 28, 2019. The disclosure of the prior applications is hereby incorporated by reference herein in its entirety.

TECHNICAL FIELD

The present invention relates to a hydraulic excavator drive system.

BACKGROUND ART

Generally speaking, in a hydraulic excavator, an arm is swingably coupled to the distal end of a boom that is luffed relative to a slewing unit, and a bucket is swingably coupled to the distal end of the arm. A drive system installed in such a hydraulic excavator includes, for example, a boom cylinder that luffs the boom, an arm cylinder that swings the arm, and a bucket cylinder that swings the bucket. These hydraulic actuators are supplied with hydraulic oil from a pump via control valves.

For example, Patent Literature 1 discloses a hydraulic excavator drive system 100 shown in FIG. 9. In the drive system 100, an arm cylinder 130 is connected to an arm control valve 120 by an arm crowding supply line 131 and an arm pushing supply line 132. The arm control valve 120 is connected to a pump 110 by a pump line 111 and to a tank by a tank line 112.

The arm control valve 120 includes a pair of pilot ports. An arm operation device 160, which is a pilot operation valve, outputs an arm crowding pilot pressure and an arm pushing pilot pressure to these pilot ports. The arm control valve 120 moves in accordance with the arm crowding pilot pressure and the arm pushing pilot pressure. The opening area of the arm control valve 120 increases in accordance with increase in the arm crowding pilot pressure and the arm pushing pilot pressure.

The drive system 100 shown in FIG. 9 adopts a configuration for regenerating the hydraulic oil discharged from the arm cylinder 130 at the time of arm crowding, the hydraulic oil being regenerated at a position upstream of the arm control valve 120, and for reducing the back pressure of the arm cylinder 130 at the time of arm pushing.

Specifically, the arm pushing supply line 132 is connected to the arm crowding supply line 131 by a regeneration line 140. The regeneration line 140 is provided with a regeneration valve 141. The regeneration line 140 is further provided with a switching valve 142 disposed between the regeneration valve 141 and the arm crowding supply line 131. A release line 150 is branched off from the regeneration line 140 at a position between the regeneration valve 141 and the switching valve 142. The release line 150 connects to the tank. The release line 150 is provided with a release valve 151.

The regeneration valve 141 is opened at the time of arm crowding, and closed at the time of arm pushing. In the illustrated example, the regeneration valve 141 is a solenoid valve whose opening area changes in accordance with an electrical signal.

The switching valve 142 is switched to a regeneration position (upper position in FIG. 9) at the time of arm crowding, and switched to a non-regeneration position (lower position in FIG. 9) at the time of arm pushing. When the switching valve 142 is in the regeneration position, the switching valve 142 prevents a flow from the arm crowding supply line 131 toward the regeneration valve 141, and allows a flow from the regeneration valve 141 toward the arm crowding supply line 131. When the switching valve 142 is in the non-regeneration position, the switching valve 142 allows a flow from the arm crowding supply line 131 toward the regeneration valve 141. In the illustrated example, the switching valve 142 is a solenoid valve that is switched between the regeneration position and the non-regeneration position in accordance with an electrical signal.

There is a case where the release valve 151 is closed at the time of arm crowding and opened at the time of arm pushing. In another case, the release valve 151 is opened both at the time of arm crowding and at the time of arm pushing. In the illustrated example, the release valve 151 is a solenoid valve whose opening area changes in accordance with an electrical signal.

CITATION LIST

Patent Literature

PTL 1: Japanese Laid-Open Patent Application Publication No. 2018-105334

SUMMARY OF INVENTION

Technical Problem

In the drive system 100 shown in FIG. 9, each of the regeneration valve 141, the switching valve 142, and the release valve 151 can be configured as a pilot-type valve that moves in accordance with a pressure led to its pilot port. In this case, a solenoid proportional valve connected to the pilot port of the regeneration valve 141, a solenoid on-off valve connected to the pilot port of the switching valve 142, and a solenoid proportional valve connected to the pilot port of the release valve 151, i.e., three solenoid valves, need to be installed.

In view of the above, an object of the present invention is to provide a hydraulic excavator drive system that makes it possible to reduce the number of solenoid valves in the case of using a pilot-type regeneration valve, a pilot-type switching valve, and a pilot-type release valve.

Solution to Problem

In order to solve the above-described problems, a hydraulic excavator drive system according to a first aspect of the present invention includes: an arm control valve connected to a pump by a pump line and to a tank by a tank line, the arm control valve moving in accordance with an arm crowding pilot pressure and an arm pushing pilot pressure; an arm cylinder connected to the arm control valve by an arm crowding supply line and an arm pushing supply line; a regeneration line that connects the arm pushing supply line to the arm crowding supply line; a regeneration valve provided on the regeneration line, the regeneration valve having an opening area that increases in accordance with increase in a pressure led to a pilot port of the regeneration valve; a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve; a release line that is branched off from the regeneration line at a position between the regeneration valve and the switching valve, the release line connecting to the tank; a release valve provided on the release line, the release valve having an opening area that increases in accordance with increase in a pressure led to a pilot port of the release valve; a first solenoid proportional valve that outputs a secondary pressure to the pilot port of the regeneration valve such that the regeneration valve opens at a time of arm crowding; and a second solenoid proportional valve that outputs a secondary pressure to the pilot port of the release valve such that the release valve opens at a time of arm pushing. The arm pushing pilot pressure for moving the arm control valve is led to the pilot port of the switching valve.

According to the above configuration, at the time of arm crowding, the regeneration valve is moved by the secondary pressure from the first solenoid proportional valve, whereas at the time of arm pushing, the switching valve is moved by the arm pushing pilot pressure for moving the arm control valve, and the release valve is moved by the secondary pressure from the second solenoid proportional valve. That is, at the time of arm pushing, the switching valve can be moved by utilizing the arm pushing pilot pressure for moving the arm control valve. This makes it possible to reduce the number of solenoid valves in the case of using a pilot-type regeneration valve, a pilot-type switching valve, and a pilot-type release valve.

In the hydraulic excavator drive system according to the first aspect, the second solenoid proportional valve may output a secondary pressure to the pilot port of the release valve such that the release valve opens not only at the time of arm pushing but also at the time of arm crowding. According to this configuration, at the time of arm crowding, the release valve can be opened to stop the regeneration.

A hydraulic excavator drive system according to a second aspect of the present invention includes: an arm control valve connected to a pump by a pump line and to a tank by a tank line, the arm control valve moving in accordance with an arm crowding pilot pressure and an arm pushing pilot pressure; an arm cylinder connected to the arm control valve by an arm crowding supply line and an arm pushing supply line; a regeneration line that connects the arm pushing supply line to the arm crowding supply line; a regeneration valve provided on the regeneration line, the regeneration valve having an opening area that increases in accordance with increase in a pressure led to a pilot port of the regeneration valve; a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve; a release line that is branched off from the regeneration line at a position between the regeneration valve and the switching valve, the release line connecting to the tank; a release valve provided on the release line, the release valve having an opening area that increases in accordance with increase in a pressure led to a pilot port of the release valve; a first solenoid proportional valve that outputs a secondary pressure to the pilot port of the regeneration valve such that the regeneration valve opens at a time of arm crowding, and outputs a secondary pressure to the pilot port of the release valve such that the release valve opens at the time of arm crowding; and a second solenoid proportional valve that outputs a secondary pressure to the pilot port of the release valve such that the release valve opens at a time of arm pushing. The arm pushing pilot pressure for moving the arm control valve is led to the pilot port of the switching valve.

According to the above configuration, at the time of arm crowding, the regeneration valve is moved by the secondary pressure from the first solenoid proportional valve, whereas at the time of arm pushing, the switching valve is moved by the arm pushing pilot pressure for moving the arm control valve, and the release valve is moved by the secondary pressure from the second solenoid proportional valve. That is, at the time of arm pushing, the switching valve can be moved by utilizing the arm pushing pilot pressure for moving the arm control valve. This makes it possible to reduce the number of solenoid valves in the case of using a pilot-type regeneration valve, a pilot-type switching valve, and a pilot-type release valve. Further, according to the above configuration, at the time of arm crowding, the release valve is also moved by the secondary pressure from the first solenoid proportional valve. Therefore, by setting the pilot pressure at which the release valve starts opening to be higher than the pilot pressure at which the regeneration valve starts opening, when the secondary pressure from the first solenoid proportional valve is made high, the release valve can be opened to stop the regeneration.

A hydraulic excavator drive system according to a third aspect of the present invention includes: an arm control valve connected to a pump by a pump line and to a tank by a tank line, the arm control valve moving in accordance with an arm crowding pilot pressure and an arm pushing pilot pressure; an arm cylinder connected to the arm control valve by an arm crowding supply line and an arm pushing supply line; a regeneration line that connects the arm pushing supply line to the arm crowding supply line; a regeneration valve provided on the regeneration line, the regeneration valve having an opening area that increases in accordance with increase in a pressure led to a pilot port of the regeneration valve; a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve; a release line that is branched off from the regeneration line at a position between the regeneration valve and the switching valve, the release line connecting to the tank; a release valve provided on the release line, the release valve having an opening area that increases in accordance with increase in a pressure led to a pilot port of the release valve; a first solenoid proportional valve that outputs a secondary pressure to the pilot port of the regeneration valve such that the regeneration valve opens at a time of arm crowding, and outputs a secondary pressure to the pilot port of the release valve such that the release valve opens at the time of arm crowding; and a second solenoid proportional valve that outputs a secondary pressure to the pilot port of the switching valve such that the switching valve is switched from the regeneration position to the non-regeneration position at a time of arm pushing, and outputs a secondary pressure to the pilot port of the release valve such that the release valve opens at the time of arm pushing.

According to the above configuration, at the time of arm crowding, the regeneration valve is moved by the secondary pressure from the first solenoid proportional valve, whereas at the time of arm pushing, the switching valve and the release valve are moved by the secondary pressure from the second solenoid proportional valve. That is, at the time of arm pushing, both the switching valve and the release valve can be moved by the single second solenoid proportional valve. This makes it possible to reduce the number of solenoid valves in the case of using a pilot-type regeneration valve, a pilot-type switching valve, and a pilot-type release valve. Further, according to the above configuration, at the time of arm crowding, the release valve is also moved by the secondary pressure from the first solenoid proportional valve. Therefore, by setting the pilot pressure at which the release valve starts opening to be higher than the pilot pressure at which the regeneration valve starts opening, when the secondary pressure from the first solenoid proportional valve is made high, the release valve can be opened to stop the regeneration.

A hydraulic excavator drive system according to a fourth aspect of the present invention includes: an arm control valve connected to a pump by a pump line and to a tank by a tank line, the arm control valve moving in accordance with an arm crowding pilot pressure and an arm pushing pilot pressure; an arm cylinder connected to the arm control valve by an arm crowding supply line and an arm pushing supply line; a regeneration line that connects the arm pushing supply line to the arm crowding supply line; a regeneration valve provided on the regeneration line, the regeneration valve having an opening area that increases in accordance with increase in a pressure led to a pilot port of the regeneration valve; a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve; a release line that is branched off from the regeneration line at a position between the regeneration valve and the switching valve, the release line connecting to the tank; a release valve provided on the release line, the release valve having an opening area that increases in accordance with increase in a pressure led to a pilot port of the release valve; and a solenoid proportional valve that outputs a secondary pressure to the pilot port of the release valve such that the release valve opens at a time of arm pushing. The arm crowding pilot pressure for moving the arm control valve is led to the pilot port of the regeneration valve, and the arm pushing pilot pressure for moving the arm control valve is led to the pilot port of the switching valve.

According to the above configuration, at the time of arm crowding, the regeneration valve is moved by the arm crowding pilot pressure for moving the arm control valve, whereas at the time of arm pushing, the switching valve is moved by the arm pushing pilot pressure for moving the arm control valve, and the release valve is moved by the secondary pressure from the solenoid proportional valve. That is, at the time of arm crowding, the regeneration valve can be moved by utilizing the arm crowding pilot pressure for moving the arm control valve, and at the time of arm pushing, the switching valve can be moved by utilizing the arm pushing pilot pressure for moving the arm control valve. This makes it possible to reduce the number of solenoid valves in the case of using a pilot-type regeneration valve, a pilot-type switching valve, and a pilot-type release valve.

In the hydraulic excavator drive system according to the fourth aspect, the solenoid proportional valve may output a secondary pressure to the pilot port of the release valve such that the release valve opens not only at the time of arm pushing but also at a time of arm crowding. According to this configuration, at the time of arm crowding, the release valve can be opened to stop the regeneration.

Advantageous Effects of Invention

The present invention makes it possible to reduce the number of solenoid valves in the case of using a pilot-type regeneration valve, a pilot-type switching valve, and a pilot-type release valve.

DESCRIPTION OF EMBODIMENTS

Embodiment 1

Figure 1:
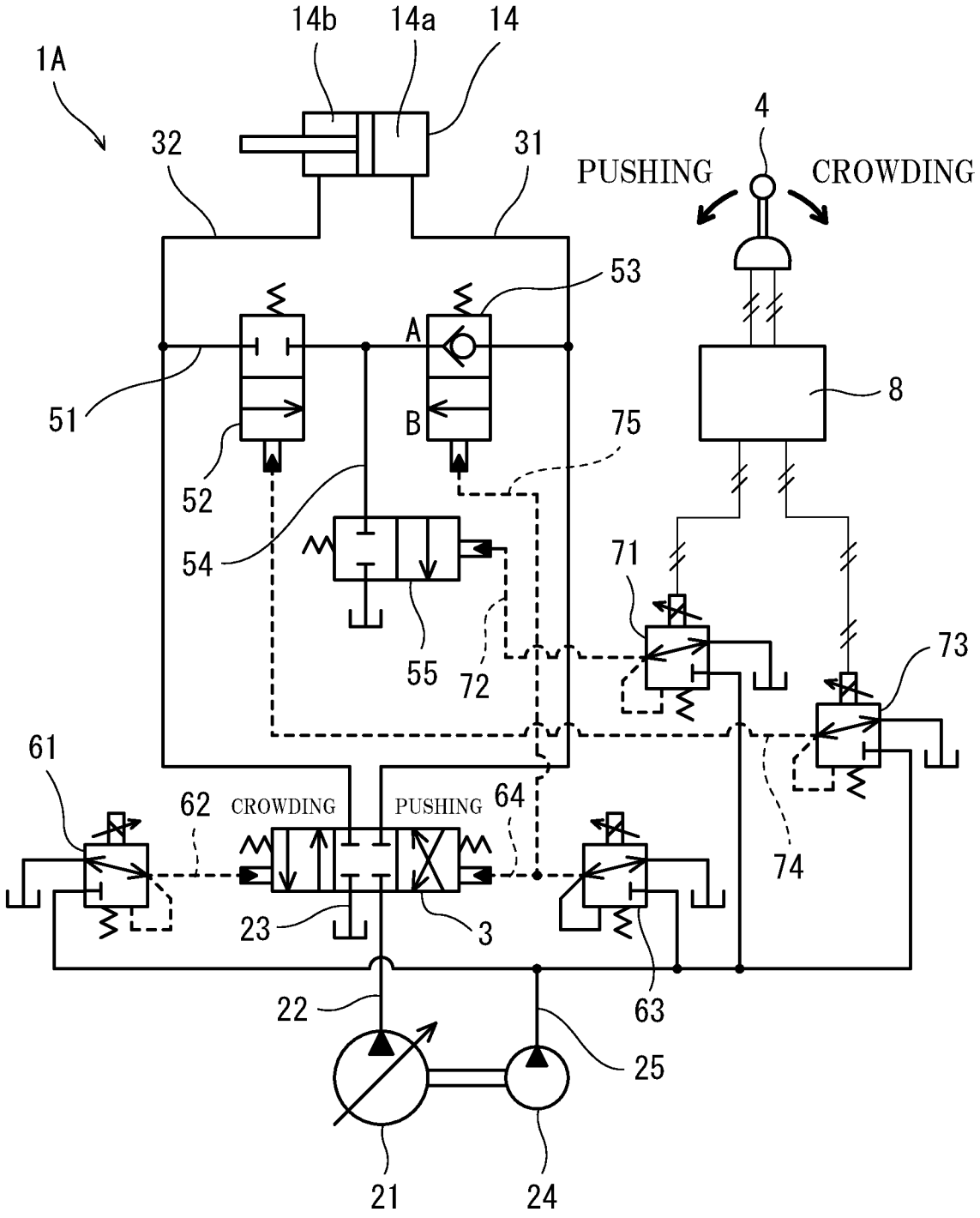
FIG. 1 shows a schematic configuration of a hydraulic excavator drive system according to Embodiment 1 of the present invention.
Figure 2:
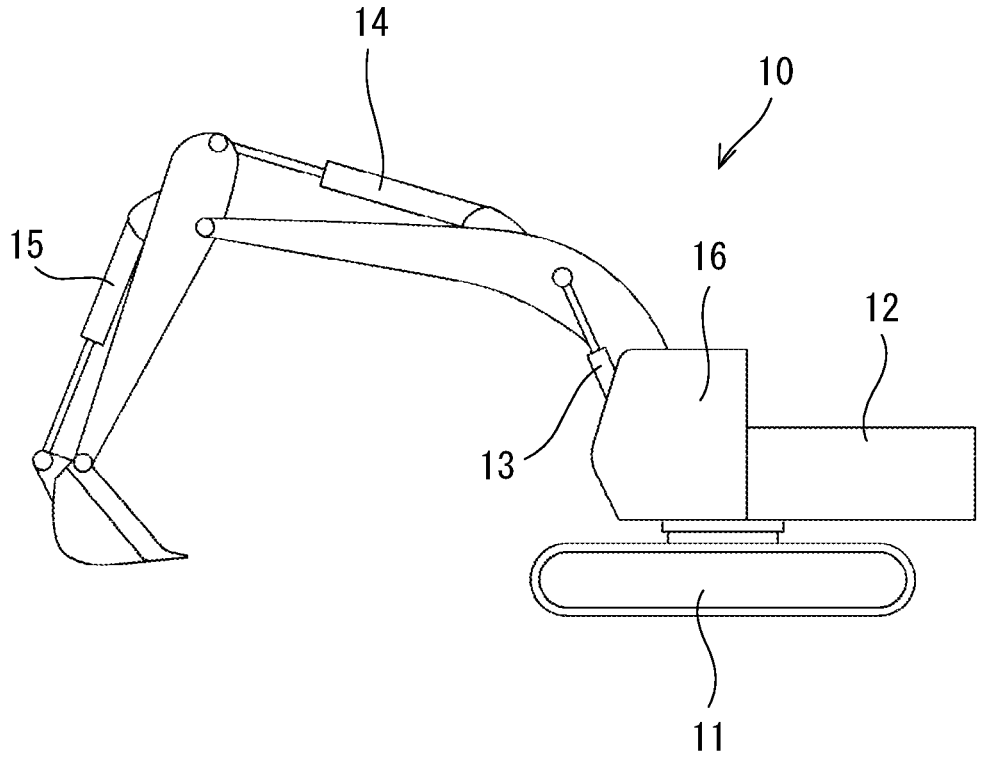
FIG. 2 is a side view of a hydraulic excavator.

FIG. 1 shows a hydraulic excavator drive system 1A according to Embodiment 1 of the present invention, and FIG. 2 shows a hydraulic excavator 10, in which the drive system 1A is installed.

The hydraulic excavator 10 shown in FIG. 2 is a self-propelled hydraulic excavator, and includes a traveling unit 11. The hydraulic excavator 10 further includes a slewing unit 12 and a boom. The slewing unit 12 is slewably supported by the traveling unit 11. The boom is luffed relative to the slewing unit 12. An arm is swingably coupled to the distal end of the boom, and a bucket is swingably coupled to the distal end of the arm. The slewing unit 12 is equipped with a cabin 16 including an operator's seat. It should be noted that the hydraulic excavator 10 need not be of a self-propelled type.

The drive system 1A includes, as hydraulic actuators, a boom cylinder 13, an arm cylinder 14, and a bucket cylinder 15, which are shown in FIG. 2, and also includes an unshown slewing motor and an unshown pair of left and right travel motors. The boom cylinder 13 luffs the boom. The arm cylinder 14 swings the arm. The bucket cylinder 15 swings the bucket. It should be noted that, in FIG. 1, the illustration of hydraulic actuators other than the arm cylinder 14 is omitted.

In the present embodiment, arm crowding to bring the arm closer to the cabin 16 is performed by extending the arm cylinder 14. Alternatively, arm pushing to move the arm away from the cabin 16 may be performed by extending the arm cylinder 14.

The drive system 1A includes a main pump 21, which supplies hydraulic oil to the aforementioned hydraulic actuators. The arm cylinder 14 is supplied with the hydraulic oil from the main pump 21 via an arm control valve 3. Although not illustrated, the other hydraulic actuators are also supplied with the hydraulic oil from the main pump 21 via control valves. The number of main pumps 21 may be one, or plural.

The arm control valve 3 controls the supply and discharge of the hydraulic oil to and from the arm cylinder 14. Specifically, the arm control valve 3 is connected to the main pump 21 by a pump line 22 and to a tank by a tank line 23. The arm control valve 3 is connected to a head chamber 14*a* of the arm cylinder 14 by an arm crowding supply line 31 and to a rod chamber 14*b* of the arm cylinder 14 by an arm pushing supply line 32.

The main pump 21 is driven by an unshown engine. The engine also drives an auxiliary pump 24. The rotation speed of the engine is kept to a constant rotation speed selected by an operator. Although not illustrated, the pump line 22 is connected to the tank by a relief line that is provided with a relief valve.

The main pump 21 is a variable displacement pump (swash plate pump or bent axis pump) whose tilting angle is changeable. The tilting angle of the main pump 21 is adjusted by an unshown regulator. For example, the delivery flow rate of the main pump 21 is controlled by electrical positive control. Alternatively, the delivery flow rate of the main pump 21 may be controlled by hydraulic negative control, or may be controlled by load-sensing control.

The arm control valve 3 is a spool valve including a spool, and includes an arm crowding pilot port for shifting the spool in one direction (to the right in FIG. 1) and an arm pushing pilot port for shifting the spool in the opposite direction (to the left in FIG. 1). The arm control valve 3 moves in accordance with an arm crowding pilot pressure led to the arm crowding pilot port and an arm pushing pilot pressure led to the arm pushing pilot port.

To be more specific, when the arm control valve 3 is in a neutral position, the arm control valve 3 blocks all of the lines 22, 23, 31, and 32, which are connected to the arm control valve 3. When the arm crowding pilot pressure becomes higher than a predetermined value, the arm control valve 3 brings the pump line 22 into communication with the arm crowding supply line 31, and brings the arm pushing supply line 32 into communication with the tank line 23. On the other hand, when the arm pushing pilot pressure becomes higher than the predetermined value, the arm control valve 3 brings the pump line 22 into communication with the arm pushing supply line 32, and brings the arm crowding supply line 31 into communication with the tank line 23. In both cases, the opening area at the meter-in side (the pump line 22 side) of the arm control valve 3, and the opening area at the meter-out side (the tank line 23 side) of the arm control valve 3, increase in accordance with increase in the pilot pressure (the arm crowding pilot pressure or the arm pushing pilot pressure).

An arm operation device 4 is disposed inside the aforementioned cabin 16. The arm operation device 4 includes an operating lever that receives an arm crowding operation and an arm pushing operation. The arm operation device 4 outputs arm operation signals (an arm crowding operation signal and an arm pushing operation signal), the magnitudes of which correspond to an arm crowding operation amount and an arm pushing operation amount, respectively (i.e., the magnitude of each arm operation signal corresponds to an inclination angle of the operating lever).

In the present embodiment, the arm operation device 4 is an electrical joystick that outputs an electrical signal as an arm operation signal. Accordingly, the arm crowding pilot port of the arm control valve 3 is connected to a crowding-side solenoid proportional valve 61 by a crowding-side pilot line 62, and the arm pushing pilot port of the arm control valve 3 is connected to a pushing-side solenoid proportional valve 63 by a pushing-side pilot line 64. The crowding-side solenoid proportional valve 61 and the pushing-side solenoid proportional valve 63 are connected to the aforementioned auxiliary pump 24 by a primary pressure line 25. Although not illustrated, the primary pressure line 25 is connected to the tank by a relief line that is provided with a relief valve.

Alternatively, the arm operation device 4 may be a pilot operation valve that outputs a pilot pressure as an arm operation signal. In this case, the arm crowding pilot port and the arm pushing pilot port of the arm control valve 3 may be connected to the arm operation device 4 by the crowding-side pilot line 62 and the pushing-side pilot line 64. Further, in this case, the crowding-side pilot line 62 and the pushing-side pilot line 64 are provided with respective pressure sensors that detect the arm crowding pilot pressure and the arm pushing pilot pressure as the arm crowding operation amount and the arm pushing operation amount, respectively.

Each of the crowding-side solenoid proportional valve 61 and the pushing-side solenoid proportional valve 63 is a direct proportional valve outputting a secondary pressure that indicates a positive correlation with a command current.

Alternatively, each of the solenoid proportional valves 61 and 63 may be an inverse proportional valve outputting a secondary pressure that indicates a negative correlation with the command current.

The crowding-side solenoid proportional valve 61 and the pushing-side solenoid proportional valve 63 are controlled by a controller 8. It should be noted that FIG. 1 shows only part of signal lines for simplifying the drawing. For example, the controller 8 is a computer including memories such as a ROM and RAM, a storage such as a HDD, and a CPU. The CPU executes a program stored in the ROM or HDD.

Figure 3:
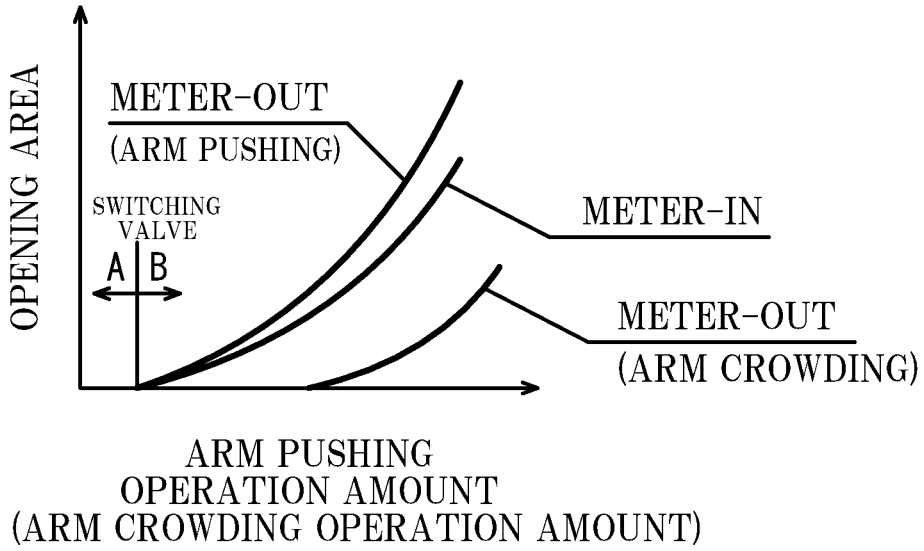
FIG. 3 is a graph showing a relationship between an arm pushing operation amount and the opening area of an arm control valve in Embodiment 1.

The arm operation signal outputted from the arm operation device 4 is inputted to the controller 8. When the arm crowding operation signal is outputted from the arm operation device 4, the controller 8 feeds a command current corresponding to the arm crowding operation signal to the crowding-side solenoid proportional valve 61. On the other hand, when the arm pushing operation signal is outputted from the arm operation device 4, the controller 8 feeds a command current corresponding to the arm pushing operation signal to the pushing-side solenoid proportional valve 63. Accordingly, as shown in FIG. 3, the meter-in opening area and the meter-out opening area of the arm control valve 3 increase in accordance with increase in the arm crowding operation amount and the arm pushing operation amount.

In the present embodiment, at the time of arm pushing, the meter-out opening area is greater than the meter-in opening area, whereas at the time of arm crowding, the meter-out opening area is less than the meter-in opening area. Alternatively, even at the time of arm crowding, the meter-out opening area may be greater than the meter-in opening area.

Further, in the present embodiment, the arm pushing supply line 32 is connected to the arm crowding supply line 31 by a regeneration line 51. The regeneration line 51 is provided with a regeneration valve 52. In the present embodiment, the regeneration valve 52 is a spool valve. Alternatively, the regeneration valve 52 may be a poppet valve.

The regeneration valve 52 is a pilot-type valve that moves in accordance with a pressure led to its pilot port (i.e., a pilot pressure). When the regeneration valve 52 is in a neutral position, the regeneration valve 52 blocks the regeneration line 51. When the pilot pressure becomes higher than or equal to a predetermined value, the regeneration valve 52 opens the regeneration line 51. That is, the opening area of the regeneration valve 52 increases in accordance with increase in the pilot pressure.

The pilot port of the regeneration valve 52 is connected to a first solenoid proportional valve 73 by a pilot line 74. That is, the first solenoid proportional valve 73 outputs a secondary pressure to the pilot port of the regeneration valve 52. The first solenoid proportional valve 73 is connected to the auxiliary pump 24 by the aforementioned primary pressure line 25.

The first solenoid proportional valve 73 is a direct proportional valve outputting a secondary pressure that indicates a positive correlation with a command current. Alternatively, the first solenoid proportional valve 73 may be an inverse proportional valve outputting a secondary pressure that indicates a negative correlation with the command current.

The regeneration line 51 is further provided with a switching valve 53 disposed between the regeneration valve 52 and the arm crowding supply line 31. For example, the switching valve 53 is a poppet valve. The switching valve 53 is a pilot-type valve that moves in accordance with a pressure led to its pilot port (i.e., a pilot pressure).

To be more specific, when the pilot pressure is lower than a setting pressure, the switching valve 53 is switched to a regeneration position A (upper position in FIG. 1), and when the pilot pressure is higher than the setting pressure, the switching valve 53 is switched to a non-regeneration position B (lower position in FIG. 1). When the switching valve 53 is in the regeneration position, the switching valve 53 prevents a flow from the arm crowding supply line 31 toward the regeneration valve 52, and allows a flow from the regeneration valve 52 toward the arm crowding supply line 31. When the switching valve 53 is in the non-regeneration position, the switching valve 53 allows a flow from the arm crowding supply line 31 toward the regeneration valve 52. In other words, in the regeneration position, the switching valve 53 functions as a check valve, whereas in the non-regeneration position, the switching valve 53 opens the regeneration line 51.

The pilot port of the switching valve 53 is connected to the aforementioned pushing-side pilot line 64 by a pilot line 75. That is, the arm pushing pilot pressure for moving the arm control valve 3 is led to the pilot port of the switching valve 53.

As shown in FIG. 3, the setting pressure, with reference to which the switching valve 53 is switched from the regeneration position A to the non-regeneration position B, is desirably lower than or equal to the pilot pressure at which the arm control valve 3 starts opening at the time of arm pushing.

A release line 54 is branched off from the regeneration line 51 at a position between the regeneration valve 52 and the switching valve 53. The release line 54 connects to the tank.

The release line 54 is provided with a release valve 55. In the present embodiment, the release valve 55 is a spool valve. Alternatively, the release valve 55 may be a poppet valve. The release valve 55 is a pilot-type valve that moves in accordance with a pressure led to its pilot port (i.e., a pilot pressure). When the release valve 55 is in a neutral position, the release valve 55 blocks the release line 54. When the pilot pressure becomes higher than or equal to a predetermined value, the release valve 55 opens the release line 54. That is, the opening area of the release valve 55 increases in accordance with increase in the pilot pressure.

The pilot port of the release valve 55 is connected to a second solenoid proportional valve 71 by a pilot line 72. That is, the second solenoid proportional valve 71 outputs a secondary pressure to the pilot port of the release valve 55. The second solenoid proportional valve 71 is connected to the auxiliary pump 24 by the aforementioned primary pressure line 25.

The second solenoid proportional valve 71 is a direct proportional valve outputting a secondary pressure that indicates a positive correlation with a command current. Alternatively, the second solenoid proportional valve 71 may be an inverse proportional valve outputting a secondary pressure that indicates a negative correlation with the command current.

Similar to the crowding-side solenoid proportional valve 61 and the pushing-side solenoid proportional valve 63, the first solenoid proportional valve 73 and the second solenoid proportional valve 71 are also controlled by the controller 8. Specifically, the controller 8 controls the first solenoid proportional valve 73 such that the regeneration valve 52 opens at the time of arm crowding, and also controls the second solenoid proportional valve 71 such that the release valve 55 opens at the time of arm pushing. Further, in the present embodiment, the controller 8 controls the second solenoid proportional valve 71 such that the release valve 55 opens also at the time of arm crowding.

Figure 4A:
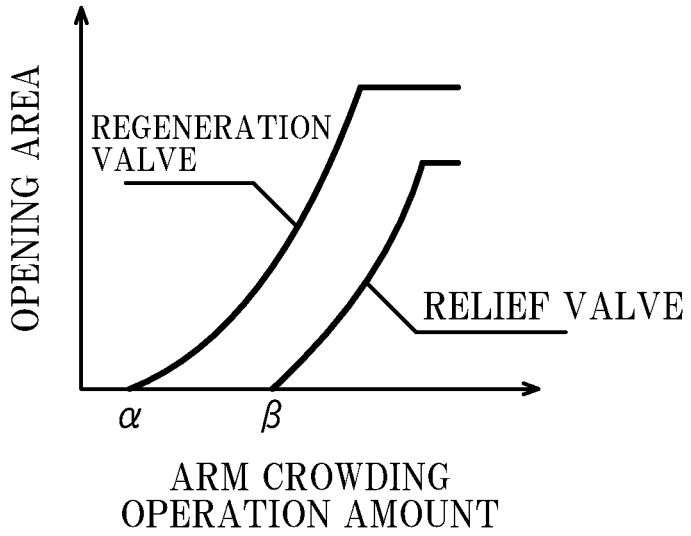
FIG. 4A is a graph showing a relationship between an arm crowding operation amount and the opening areas of a regeneration valve and a release valve.

To be more specific, at the time of arm crowding, the controller 8 feeds a command current to the first solenoid proportional valve 73 such that, as shown in FIG. 4A, the opening area of the regeneration valve 52 increases in accordance with increase in the arm crowding operation amount (i.e., in accordance with increase in the arm crowding operation signal). Also, the controller 8 feeds a command current to the second solenoid proportional valve 71 such that the opening area of the release valve 55 increases in accordance with increase in the arm crowding operation amount.

Desirably, an arm crowding operation amount β when the release valve 55 starts opening is greater than an arm crowding operation amount α when the regeneration valve 52 starts opening. Desirably, the opening area of the release valve 55 is less than the opening area of the regeneration valve 52.

Figure 4B:
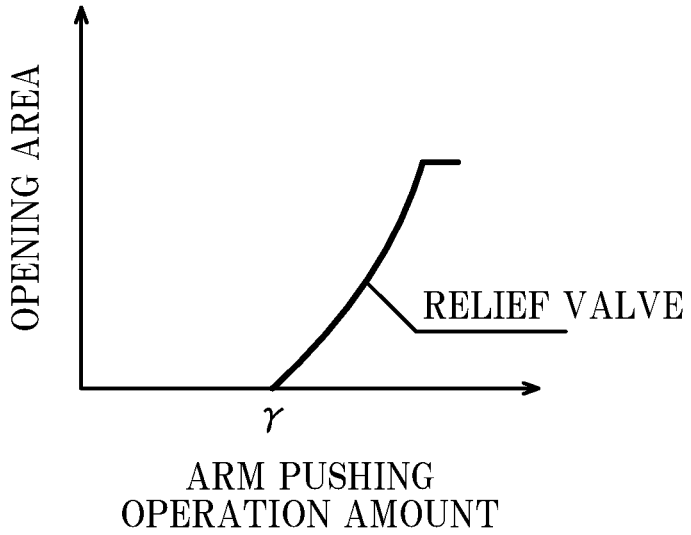
FIG. 4B is a graph showing a relationship between an arm pushing operation amount and the opening area of the release valve.

On the other hand, at the time of arm pushing, the controller 8 feeds a command current to the second solenoid proportional valve 71 such that, as shown in FIG. 4B, the opening area of the release valve 55 increases in accordance with increase in the arm pushing operation amount.

An arm pushing operation amount γ when the release valve 55 starts opening is not particularly limited. For example, the arm pushing operation amount γ when the release valve 55 starts opening may be equal to, less than, or greater than the arm pushing operation amount when the arm control valve 3 starts opening.

Hereinafter, operations of the drive system 1A are described.

At the time of arm crowding, when the arm crowding operation amount is less than β in FIG. 4A, the regeneration valve 52 opens while the release valve 55 is kept closed. Meanwhile, since the arm pushing pilot pressure is zero, the switching valve 53 is kept in the regeneration position. Accordingly, in a case where the pressure of the head chamber 14*a* of the arm cylinder 14 is lower than the pressure of the rod chamber 14*b*, part of the hydraulic oil discharged from the rod chamber 14*b* of the arm cylinder 14 flows through the regeneration line 51 (the regeneration valve 52 and the switching valve 53) and is supplied to the head chamber 14*a* to be regenerated. When the arm crowding operation amount becomes greater than β in FIG. 4A, the release valve 55 is opened to stop the regeneration.

At the time of arm pushing, the switching valve 53 is switched to the non-regeneration position by the arm pushing pilot pressure outputted from the pushing-side solenoid proportional valve 63. When the arm pushing operation amount is less than γ in FIG. 4B, the release valve 55 is kept closed. However, when the arm pushing operation amount becomes greater than γ, the release valve 55 is opened. As a result, the hydraulic oil discharged from the head chamber 14*a* of the arm cylinder 14 returns to the tank by flowing through a part of the regeneration line 51 (from the arm crowding supply line 31 to the branch point where the release line 54 is branched off from the regeneration line 51) and the release line 54 (the release valve 55), and also, returns to the tank by flowing through the arm control valve 3 and the tank line 23. This makes it possible to reduce the back pressure of the arm cylinder 14.

As described above, in the drive system 1A of the present embodiment, at the time of arm crowding, the regeneration valve 52 is moved by the secondary pressure from the first solenoid proportional valve 73, whereas at the time of arm pushing, the switching valve 53 is moved by the arm pushing pilot pressure for moving the arm control valve 3, and the release valve 55 is moved by the secondary pressure from the second solenoid proportional valve 71. That is, at the time of arm pushing, the switching valve 53 can be moved by utilizing the arm pushing pilot pressure for moving the arm control valve 3. This makes it possible to reduce the number of solenoid valves in the case of using the pilot-type regeneration valve 52, the pilot-type switching valve 53, and the pilot-type release valve 55.

The regeneration valve 52 and the release valve 55 may be single valves that are independent of each other. Alternatively, the regeneration valve 52 and the release valve 55 may constitute a multi-control valve together with the arm control valve 3. In this case, the spool of the arm control valve 3, the spool of the regeneration valve 52, and the spool of the release valve 55 are arranged parallel to each other in a housing. By adopting this configuration, not only the arm control valve 3 but also the regeneration valve 52 and the release valve 55 can be incorporated in one multi-control valve.

Embodiment 2

Figure 5:
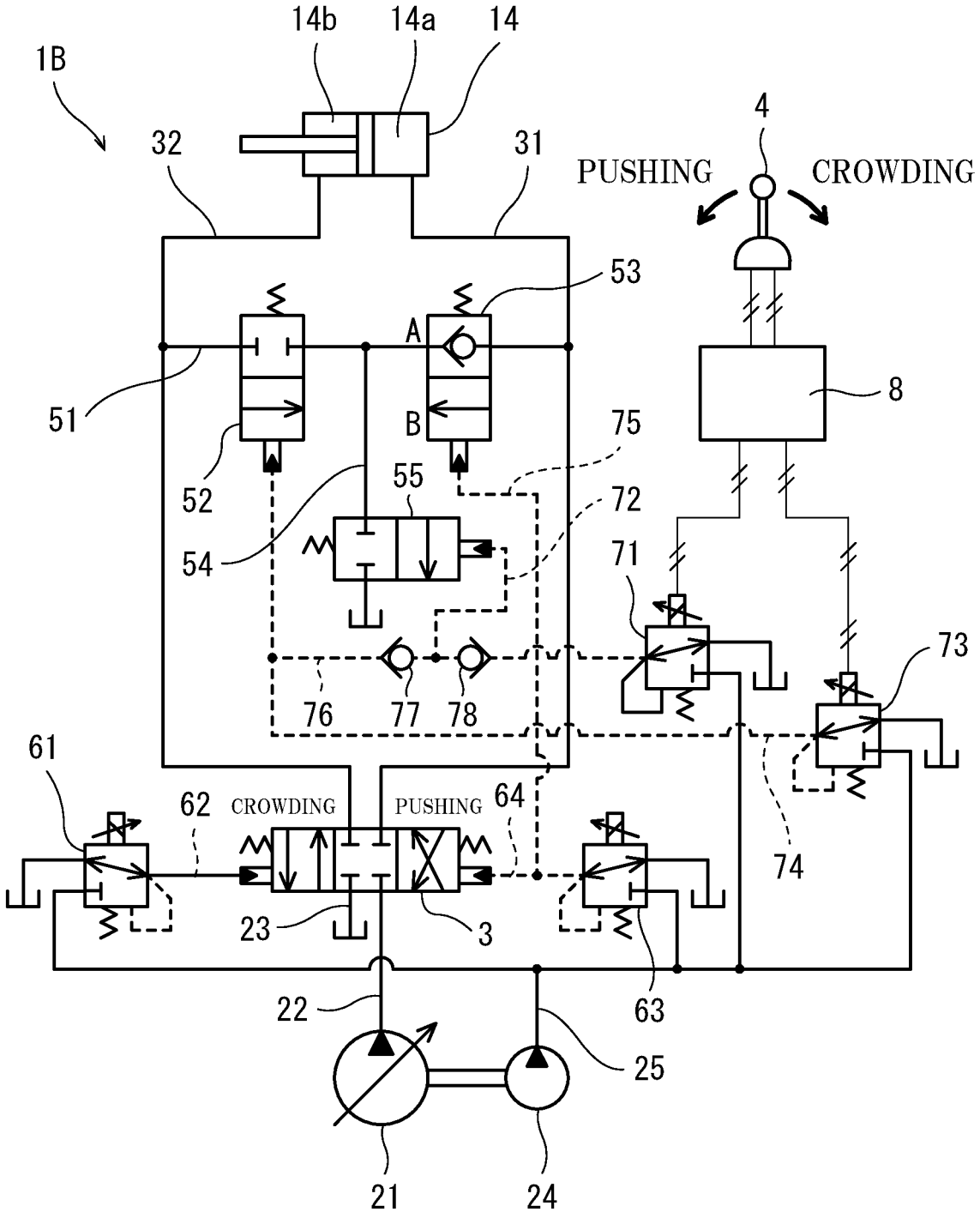
FIG. 5 shows a schematic configuration of a hydraulic excavator drive system according to Embodiment 2 of the present invention.

FIG. 5 shows a hydraulic excavator drive system 1B according to Embodiment 2 of the present invention. It should be noted that, in the present embodiment, the same components as those described in Embodiment 1 are denoted by the same reference signs as those used in Embodiment 1, and repeating the same descriptions is avoided.

In the present embodiment, the pilot line 74, which leads the secondary pressure from the first solenoid proportional valve 73 to the pilot port of the regeneration valve 52, and the pilot line 72, which leads the secondary pressure from the second solenoid proportional valve 71 to the pilot port of the release valve 55, are connected to each other by a relay line 76. The relay line 76 is provided with a check valve 77, which allows a flow from the pilot line 74 toward the pilot line 72, but prevents the reverse flow. The pilot line 72 is provided with a check valve 78, which is disposed between the second solenoid proportional valve 71 and a point where the relay line 76 is joined to the pilot line 72. The check valve 78 allows a flow from the second solenoid proportional valve 71 toward the release valve 55, but prevents the reverse flow. It should be noted that high pressure selective valves may be used instead of the two check valves 77 and 78.

In Embodiment 1, the controller 8 controls the second solenoid proportional valve 71 such that the release valve 55 opens at the time of arm crowding. However, in the present embodiment, at the time of arm crowding, the controller 8 feeds no command current to the second solenoid proportional valve 71. Instead, at the time of arm crowding, the controller 8 feeds a command current to the first solenoid proportional valve 73, such that the release valve 55 is opened by the secondary pressure from the first solenoid proportional valve 73.

Similar to Embodiment 1, the present embodiment has the advantage of making it possible to reduce the number of solenoid valves in the case of using the pilot-type regeneration valve 52, the pilot-type switching valve 53, and the pilot-type release valve 55. Further, in the present embodiment, at the time of arm crowding, the release valve 55 is also moved by the secondary pressure from the first solenoid proportional valve 73. Therefore, by setting the pilot pressure at which the release valve 55 starts opening (i.e., the pressure corresponding to the arm crowding operation amount β in FIG. 4A) to be higher than the pilot pressure at which the regeneration valve 52 starts opening (i.e., the pressure corresponding to the arm crowding operation amount α in FIG. 4A), when the secondary pressure from the first solenoid proportional valve 73 is made high, the release valve 55 can be opened to stop the regeneration.

It should be noted that, in the present embodiment, the regeneration valve 52 and the release valve 55 cannot be controlled independently of each other. However, the present embodiment has the advantage of being able to readily prevent the following phenomenon: the opening area of the regeneration valve 52 and the opening area of the release valve 55, both corresponding to the arm crowding operation amount, are affected by a variation in the secondary pressure from the first solenoid proportional valve 73 and a variation in the secondary pressure from the second solenoid proportional valve 71 (here, the variations in these secondary pressures each corresponding to a command current are caused by individual differences of the solenoid proportional valves 71 and 73), and thereby the operation feeling is affected. On the other hand, Embodiment 1 has the advantage that the regeneration valve 52 and the release valve 55 can be controlled independently of each other.

Embodiment 3

Figure 6:
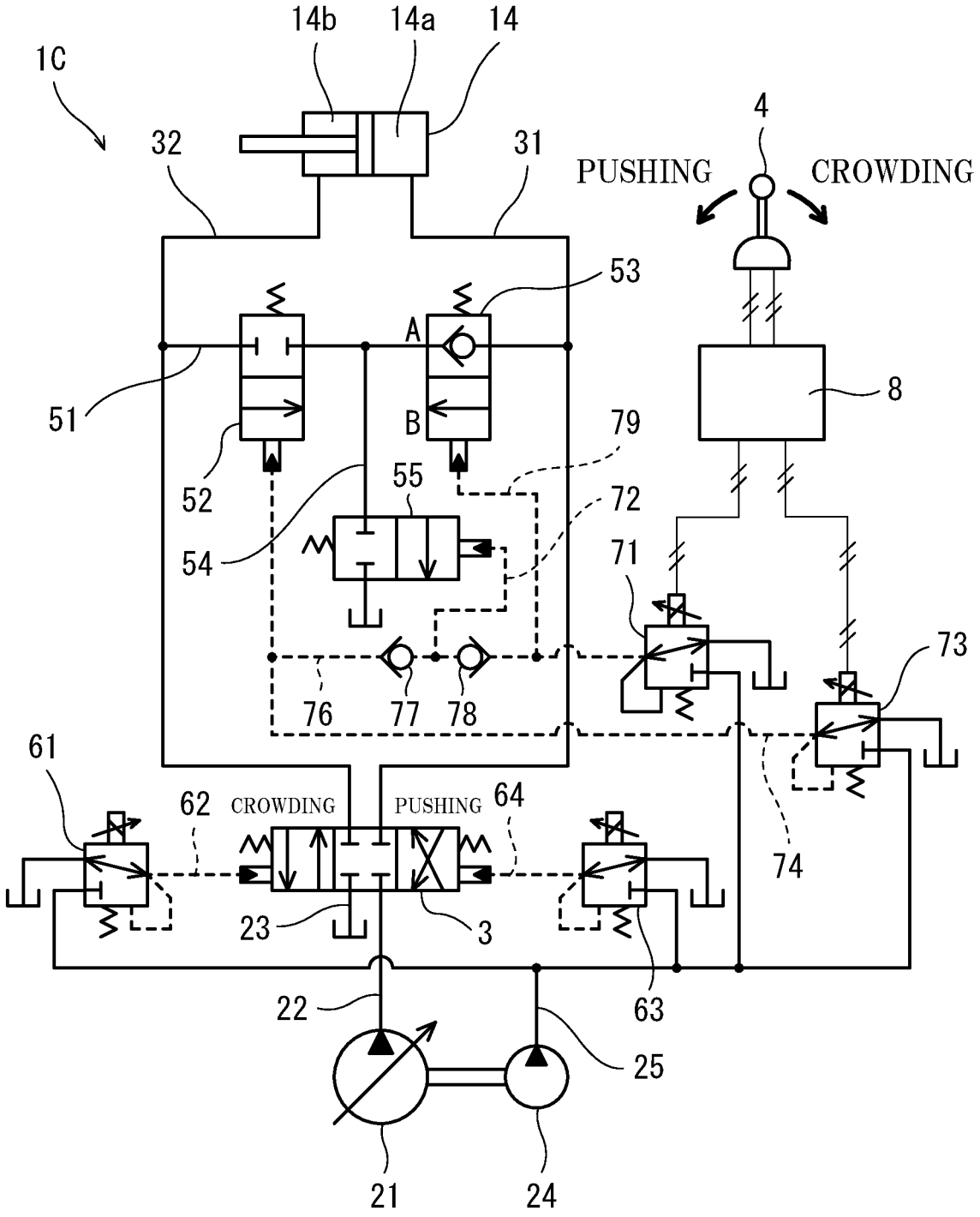
FIG. 6 shows a schematic configuration of a hydraulic excavator drive system according to Embodiment 3 of the present invention.

FIG. 6 shows a hydraulic excavator drive system 1C according to Embodiment 3 of the present invention. It should be noted that, in the present embodiment, the same components as those described in Embodiment 2 are denoted by the same reference signs as those used in Embodiment 2, and repeating the same descriptions is avoided.

The only difference between the drive system 1C of the present embodiment and the drive system 1B of Embodiment 2 is that, in the drive system 1C, the pilot port of the switching valve 53 is connected by a pilot line 79 to the pilot line 72 at a position between the second solenoid proportional valve 71 and the check valve 78. That is, at the time of arm pushing, the switching valve 53 is switched from the regeneration position to the non-regeneration position by the secondary pressure from the second solenoid proportional valve 71.

In the present embodiment, at the time of arm crowding, the regeneration valve 52 is moved by the secondary pressure from the first solenoid proportional valve 73, whereas at the time of arm pushing, the switching valve 53 and the release valve 55 are moved by the secondary pressure from the second solenoid proportional valve 71. That is, at the time of arm pushing, both the switching valve 53 and the release valve 55 can be moved by the single second solenoid proportional valve 71. This makes it possible to reduce the number of solenoid valves in the case of using the pilot-type regeneration valve 52, the pilot-type switching valve 53, and the pilot-type release valve 55. Further, in the present embodiment, at the time of arm crowding, the release valve 55 is also moved by the secondary pressure from the first solenoid proportional valve 73. Therefore, by setting the pilot pressure at which the release valve 55 starts opening (i.e., the pressure corresponding to the arm crowding operation amount β in FIG. 4A) to be higher than the pilot pressure at which the regeneration valve 52 starts opening (i.e., the pressure corresponding to the arm crowding operation amount α in FIG. 4A), when the secondary pressure from the first solenoid proportional valve 73 is made high, the release valve 55 can be opened to stop the regeneration.

Embodiment 4

Figure 7:
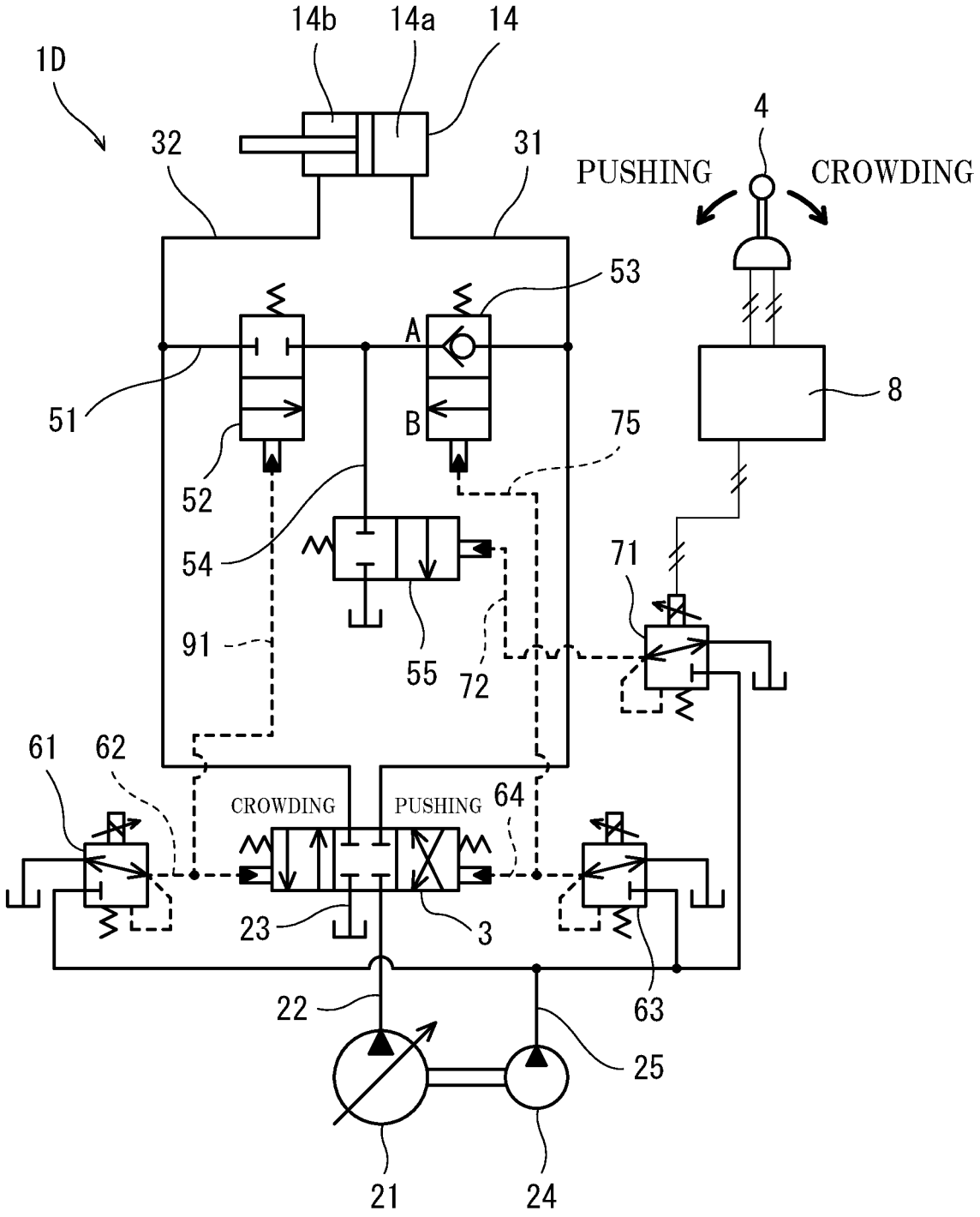
FIG. 7 shows a schematic configuration of a hydraulic excavator drive system according to Embodiment 4 of the present invention.
Figure 8:
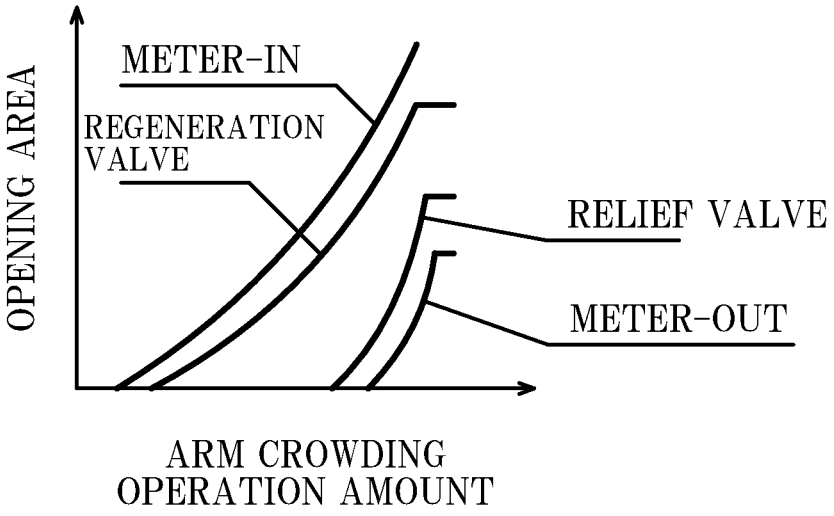
FIG. 8 is a graph showing a relationship between an arm crowding operation amount and the opening areas of the arm control valve, the regeneration valve, and the release valve in Embodiment 4.
Figure 9:
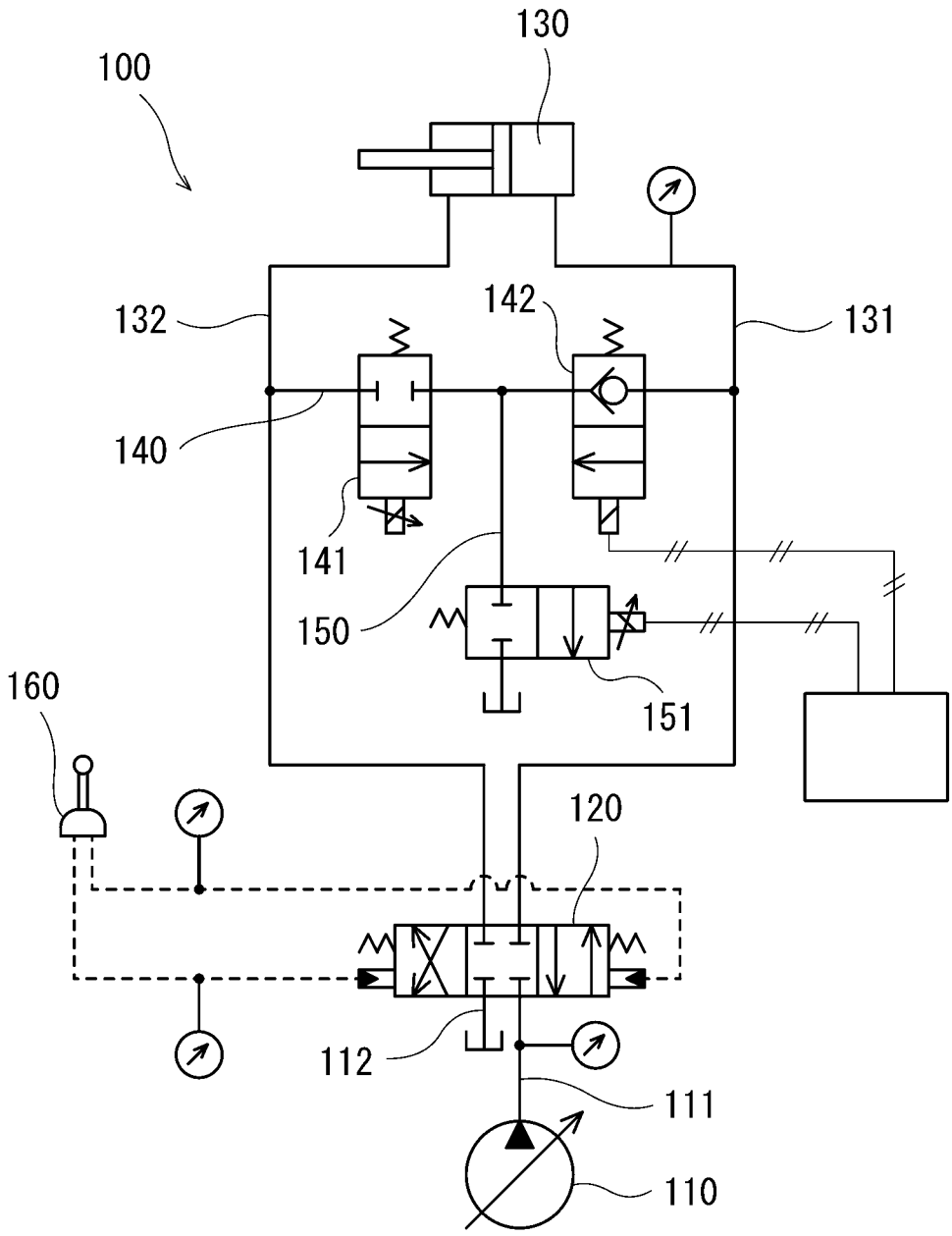
FIG.9 PRIOR ART
FIG. 9 shows a schematic configuration of a conventional hydraulic excavator drive system.

FIG. 7 shows a hydraulic excavator drive system 1D according to Embodiment 4 of the present invention. It should be noted that, in the present embodiment, the same components as those described in Embodiment 1 are denoted by the same reference signs as those used in Embodiment 1, and repeating the same descriptions is avoided.

A significant difference between the drive system 1D of the present embodiment and the drive system 1A of Embodiment 1 is that, in the drive system 1D, the first solenoid proportional valve 73 is eliminated, and instead, the pilot port of the regeneration valve 52 is connected to the crowding-side pilot line 62 by a pilot line 91. That is, the arm crowding pilot pressure for moving the arm control valve 3 is led to the pilot port of the regeneration valve 52.

Also, in the present embodiment, at the time of arm crowding, the arm control valve 3 may block the arm pushing supply line 32 without bringing the arm pushing supply line 32 into communication with the tank line 23.

The controller 8 controls the solenoid proportional valve 71 in the same manner as described in Embodiment 1. Accordingly, at the time of arm crowding, when the arm crowding operation amount is small, the hydraulic oil discharged from the rod chamber 14*b* of the arm cylinder 14 is partly regenerated, and when the arm crowding operation amount is large, the release valve 55 is opened to stop the regeneration. At the time of arm pushing, when the arm pushing operation amount is large, the release valve 55 is opened to reduce the back pressure of the arm cylinder 14.

In the present embodiment, at the time of arm crowding, the regeneration valve 52 is moved by the arm crowding pilot pressure for moving the arm control valve 3, whereas at the time of arm pushing, the switching valve 53 is moved by the arm pushing pilot pressure for moving the arm control valve 3, and the release valve 55 is moved by the secondary pressure from the solenoid proportional valve 71. That is, at the time of arm crowding, the regeneration valve 52 can be moved by utilizing the arm crowding pilot pressure for moving the arm control valve 3, and at the time of arm pushing, the switching valve 53 can be moved by utilizing the arm pushing pilot pressure for moving the arm control valve 3. This makes it possible to reduce the number of solenoid valves in the case of using the pilot-type regeneration valve 52, the pilot-type switching valve 53, and the pilot-type release valve 55.

It should be noted that, in the present embodiment, the regeneration valve 52 and the arm control valve 3 cannot be controlled independently of each other. However, since the regeneration valve 52 and the arm control valve 3 are commonly controlled by the secondary pressure from the crowding-side solenoid proportional valve 61, the following problem can be prevented: the properties of the opening areas of the regeneration valve 52 and the arm control valve 3, the opening areas both corresponding to the arm crowding operation amount, vary due to a manufacturing variation in the secondary pressure from the crowding-side solenoid proportional valve 61 and a manufacturing variation in the secondary pressure from the first solenoid proportional valve 73, and thereby the operability is affected. On the other hand, Embodiment 1 has the advantage that the regeneration valve 52 and the arm control valve 3 can be controlled independently of each other.

Other Embodiments

The present invention is not limited to the above-described embodiments. Various modifications can be made without departing from the scope of the present invention.

For example, in Embodiment 1 and Embodiment 4, at the time of arm crowding, the controller 8 need not output a secondary pressure to the pilot port of the release valve 55.

The invention claimed is:

1. A hydraulic excavator drive system comprising:

an arm control valve connected to a pump by a pump line and to a tank by a tank line, the arm control valve moving in accordance with an arm crowding pilot pressure and an arm pushing pilot pressure;

an arm cylinder connected to the arm control valve by an arm crowding supply line and an arm pushing supply line;

a regeneration line that connects the arm pushing supply line to the arm crowding supply line;

a regeneration valve provided on the regeneration line, the regeneration valve having an opening area that increases in accordance with increase in a pressure led to a pilot port of the regeneration valve;

a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve;

a release line that is branched off from the regeneration line at a position between the regeneration valve and the switching valve, the release line connecting to the tank;

a release valve provided on the release line, the release valve having an opening area that increases in accordance with increase in a pressure led to a pilot port of the release valve;

a first solenoid proportional valve that outputs a secondary pressure to the pilot port of the regeneration valve such that the regeneration valve opens at a time of arm crowding; and a second solenoid proportional valve that outputs a secondary pressure to the pilot port of the release valve such that the release valve opens at a time of arm pushing, wherein the arm pushing pilot pressure for moving the arm control valve is led to the pilot port of the switching valve.

2. The hydraulic excavator drive system according to claim 1, wherein the second solenoid proportional valve outputs a secondary pressure to the pilot port of the release valve such that the release valve opens not only at the time of arm pushing but also at the time of arm crowding.

3. A hydraulic excavator drive system comprising:

an arm control valve connected to a pump by a pump line and to a tank by a tank line, the arm control valve moving in accordance with an arm crowding pilot pressure and an arm pushing pilot pressure;

an arm cylinder connected to the arm control valve by an arm crowding supply line and an arm pushing supply line;

a regeneration line that connects the arm pushing supply line to the arm crowding supply line;

a regeneration valve provided on the regeneration line, the regeneration valve having an opening area that increases in accordance with increase in a pressure led to a pilot port of the regeneration valve;

a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve;

a release line that is branched off from the regeneration line at a position between the regeneration valve and the switching valve, the release line connecting to the tank;

a release valve provided on the release line, the release valve having an opening area that increases in accordance with increase in a pressure led to a pilot port of the release valve;

a first solenoid proportional valve that outputs a secondary pressure to the pilot port of the regeneration valve such that the regeneration valve opens at a time of arm crowding, and outputs a secondary pressure to the pilot port of the release valve such that the release valve opens at the time of arm crowding; and a second solenoid proportional valve that outputs a secondary pressure to the pilot port of the release valve such that the release valve opens at a time of arm pushing, wherein the arm pushing pilot pressure for moving the arm control valve is led to the pilot port of the switching valve.

4. A hydraulic excavator drive system comprising:

an arm control valve connected to a pump by a pump line and to a tank by a tank line, the arm control valve moving in accordance with an arm crowding pilot pressure and an arm pushing pilot pressure;

an arm cylinder connected to the arm control valve by an arm crowding supply line and an arm pushing supply line;

a regeneration line that connects the arm pushing supply line to the arm crowding supply line;

a regeneration valve provided on the regeneration line, the regeneration valve having an opening area that increases in accordance with increase in a pressure led to a pilot port of the regeneration valve;

a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve;

a release line that is branched off from the regeneration line at a position between the regeneration valve and the switching valve, the release line connecting to the tank;

a release valve provided on the release line, the release valve having an opening area that increases in accordance with increase in a pressure led to a pilot port of the release valve;

a first solenoid proportional valve that outputs a secondary pressure to the pilot port of the regeneration valve such that the regeneration valve opens at a time of arm crowding, and outputs a secondary pressure to the pilot port of the release valve such that the release valve opens at the time of arm crowding; and a second solenoid proportional valve that outputs a secondary pressure to the pilot port of the switching valve such that the switching valve is switched from the regeneration position to the non-regeneration position at a time of arm pushing, and outputs a secondary pressure to the pilot port of the release valve such that the release valve opens at the time of arm pushing.

5. A hydraulic excavator drive system comprising:

an arm control valve connected to a pump by a pump line and to a tank by a tank line, the arm control valve moving in accordance with an arm crowding pilot pressure and an arm pushing pilot pressure;

an arm cylinder connected to the arm control valve by an arm crowding supply line and an arm pushing supply line;

a regeneration line that connects the arm pushing supply line to the arm crowding supply line;

a regeneration valve provided on the regeneration line, the regeneration valve having an opening area that increases in accordance with increase in a pressure led to a pilot port of the regeneration valve;

a switching valve provided on the regeneration line at a position between the regeneration valve and the arm crowding supply line, the switching valve being switched to a regeneration position when a pressure led to a pilot port of the switching valve is lower than a setting pressure and switched to a non-regeneration position when the pressure led to the pilot port of the switching valve is higher than the setting pressure, the regeneration position being a position in which the switching valve prevents a flow from the arm crowding supply line toward the regeneration valve and allows a flow from the regeneration valve toward the arm crowding supply line, the non-regeneration position being a position in which the switching valve allows a flow from the arm crowding supply line toward the regeneration valve;

a release line that is branched off from the regeneration line at a position between the regeneration valve and the switching valve, the release line connecting to the tank;

a release valve provided on the release line, the release valve having an opening area that increases in accordance with increase in a pressure led to a pilot port of the release valve; and a solenoid proportional valve that outputs a secondary pressure to the pilot port of the release valve such that the release valve opens at a time of arm pushing, wherein the arm crowding pilot pressure for moving the arm control valve is led to the pilot port of the regeneration valve, and the arm pushing pilot pressure for moving the arm control valve is led to the pilot port of the switching valve.

6. The hydraulic excavator drive system according to claim 5, wherein the solenoid proportional valve outputs a secondary pressure to the pilot port of the release valve such that the release valve opens not only at the time of arm pushing but also at a time of arm crowding.

* * * * *